US006824018B1

(12) United States Patent
Eaddy et al.

(10) Patent No.: US 6,824,018 B1
(45) Date of Patent: Nov. 30, 2004

(54) CHILD SAFE CREAM DISPENSER

(76) Inventors: Christopher Eaddy, 513 Hanska Way, Raleigh, NC (US) 27610; Todd Marshall, P.O. Box 936, Wake Forest, NC (US) 27588; Bob Marshall, P.O. Box 936, Wake Forest, NC (US) 27588

( * ) Notice: Subject to any disclaimer, the term of this patent is extended or adjusted under 35 U.S.C. 154(b) by 0 days.

(21) Appl. No.: 10/816,924

(22) Filed: Apr. 5, 2004

(51) Int. Cl.[7] ..... B67B 5/00; B67D 5/42

(52) U.S. Cl. ..... 222/153.13; 222/153.14; 222/391; 222/516; 222/517

(58) Field of Search ..... 222/153.13, 153.14, 222/391, 392, 473, 505, 516, 517

(56) References Cited

U.S. PATENT DOCUMENTS

| | | | | | |
|---|---|---|---|---|---|
| 2,118,154 | A | * | 5/1938 | Buedingen | 222/44 |
| 3,229,865 | A | * | 1/1966 | Heisler et al. | 222/391 |
| 3,410,461 | A | * | 11/1968 | Barker | 222/516 |
| 4,055,146 | A | * | 10/1977 | Smrt | |
| 4,139,127 | A | * | 2/1979 | Gentile | |
| 4,144,988 | A | * | 3/1979 | Bergman | |
| 4,318,499 | A | * | 3/1982 | Hamilton | 222/327 |
| 4,749,106 | A | * | 6/1988 | von Schuckmann et al. | |
| 4,793,526 | A | * | 12/1988 | Webb | |
| 4,805,805 | A | * | 2/1989 | Ocheskey | |
| 4,805,810 | A | * | 2/1989 | Czetwertynski | |
| 4,826,044 | A | * | 5/1989 | Volfson | |
| 4,886,186 | A | | 12/1989 | Andris | |
| 4,917,273 | A | * | 4/1990 | Seager | 222/392 |
| 4,998,645 | A | | 3/1991 | Pearson | |
| 5,062,551 | A | * | 11/1991 | Goldstein et al. | 222/390 |
| 5,169,034 | A | | 12/1992 | Kozam | |
| 6,082,565 | A | | 7/2000 | Harrold | |
| 6,098,835 | A | | 8/2000 | DeJonge | |
| 6,186,364 | B1 | | 2/2001 | Dobbs | |
| 6,321,945 | B1 | * | 11/2001 | Girouard et al. | 222/113 |
| 2003/0129921 | A1 | | 7/2003 | Small et al. | |

FOREIGN PATENT DOCUMENTS

| | | | |
|---|---|---|---|
| DE | 3923828 C1 | * | 12/1990 |
| GB | 2108207 A | * | 5/1983 |

* cited by examiner

*Primary Examiner*—Patrick M. Buechner
*Assistant Examiner*—Patrick Buechner
(74) *Attorney, Agent, or Firm*—Richard C. Litman

(57) ABSTRACT

The child safe cream dispenser is a child-resistant pump-actuated dispenser for topical preparations having an elongated housing, the housing defining a container for holding a supply of cream or other viscous material. A plunger mechanism functions to advance a piston through a one-way ratchet or clutch mechanism so that successive operation of the plunger mechanism causes the piston to advance towards a dispensing opening. A trigger release mechanism disables the plunger mechanism until a release button has cleared the sidewall of the housing. The dispensing outlet may have a cap or a ball valve that is either pivoted or rotated to an open position by operation of the plunger trigger.

13 Claims, 6 Drawing Sheets

CHILD SAFE CREAM DISPENSER

BACKGROUND OF THE INVENTION

1. Field of the Invention

The present invention relates generally to dispensers, and in particular, to a child-resistant dispenser for dispensing creams, emulsions, and similar viscous material through openings or apertures.

2. Description of the Related Art

Cream or otherwise flowing material placed in a container can be extruded through an opening by means of a pusher or plunger which is advanced by any number of mechanisms, including rotating, squeezing, pushing, or pressing a control device. Although dispensers for cream cover a broad spectrum of design complexity, most lack a means of preventing small children from operating the devices, the contents of which may contain controlled substances or preparations not appropriate for use by small children.

U.S. Pat. No. 4,805,805, issued to G. Ocheskey in February 1989, discloses a tube dispenser that utilizes a linear ratchet actuated pusher for squeezing the contents from tubes containing tub and tile caulk. The tube is supported on a support plate with a nozzle extending through an aperture formed in an end wall connected to the support plate. The device of the '805 patent includes a handle, mounted on an opposite end wall, an attached ratchet actuation lever, and a toothed rod extending through an aperture in the end wall adjacent the handle. Designed for general-purpose use, the device described in the '805 patent does not incorporate or teach a child safety mechanism preventing use by young children. Similarly, U.S. Pat. No. 4,826,044, issued to Volfson in May 1989, discloses a dispenser for dual extrusion of viscous fluids comprising a container having an opening, a collapsible sleeve insert, and a piston engaging one end of the sleeve insert.

In a similar fashion, U.S. Pat. No. 4,886,186, issued to Andris in December 1989, discloses a dispenser having a piston, which moves upwards in conjunction with the upward movement of a toothed push rod, while movement of the piston is arrested during the reciprocating downward movement of the push rod.

Other dispensers utilizing ratchet mechanisms to advance a plunger include U.S. Pat. No. 4,749,106, issued to von Schuckmann et al. in June 1988, U.S. Pat. No. 4,805,810, issued to Czetwertynski in February 1989, U.S. Pat. No. 5,169,034, issued to Kozam in December 1992, Great Britain Patent Application No. 2,108,207, published in May 1983, and German Patent No. 3,923,828, published in December 1990.

In addition to ratchet mechanisms to advance the plunger, U.S. Pat. No. 4,998,645, issued to Pearson in March 1989, includes a trigger-activated, ratchet-controlled takeup roller adapted for receiving the squeeze end of a collapsible tube. U.S. Pat. No. 4,139,127, issued to Gentile in February 1979, discloses an alternate mechanism for advancing a dispensing plunger. Having a screw-mounted plunger, the apparatus disclosed in the '127 patent is a dispenser that dispenses material by means of rotating a portion of the applicator in one direction only. Another device based upon rotation of a screw to advance a plunger is shown in U.S. Pat. No. 4,144,988, issued to Bergman in March 1979.

Plungers advanced by means other than screws and ratchets include U.S. Pat. No. 4,793,526, issued to Webb in December 1988, which discloses a paste dispenser that advances a push plate by means of a cable connected to a drum at the other end of a tubular body. Tension in the cable urges the plate towards the opposite end of the tubular body, thereby dispensing the material contained.

U.S. Pat. No. 4,055,146, issued to Smrt in October 1997, teaches an automatic feeding device, which incorporates a rotary valve operated by a ratchet wheel.

The foregoing devices do not address the issue of child safety. However, several dispensing devices have addressed the issue of child safety. U.S. Pat. No. 6,082,565, issued to Harrold in July 2000, discloses a child resistant cap and dispenser which includes a dispensing container, a flange having one-way ratchets located thereon, and a cap and spring mechanism wherein the cap is biased upwardly away from the dispensing container so as to require a downward movement to engage the cap with the ratchet before a rotational force can be brought to bear on the ratchet to open the container.

Three additional devices relevant to the field of child resistant containers include U.S. Pat. No. 6,098,835, issued to S. DeJonge in August 2000; U.S. Pat. No. 6,186,364, issued to D. Dobbs, in February 2001; and U.S. Patent Publication No. 2003/0129921, published in July 2003.

None of the above inventions and patents, taken either singly or in combination, is seen to describe the instant invention as claimed. Thus a child safe cream dispenser solving the aforementioned problems is desired.

SUMMARY OF THE INVENTION

The child safe cream dispenser is a pump-actuated dispenser for topical preparations which includes a mechanism for minimizing the risk of access by small children. The dispenser comprises an elongated housing, the housing defining a container for holding a supply of cream or other viscous material. Included in the container is a sidewall, a bottom wall, a dispensing outlet, and a piston with a flexible piston shaft designed to slidably move and snugly fit within the interior walls of the container. A "J" shaped passageway is defined in the interior walls that extends from the bottom of the container and curves upwards for the length of the elongated housing, guiding the piston shaft. A plunger mechanism functions to advance the piston through a one-way ratchet or clutch mechanism so that successive operation of the plunger mechanism causes the piston to advance towards the dispensing opening.

The plunger mechanism has a spring-biased trigger, whereby the plunger is returned to its normal or rest position once the trigger is released. Child safety is addressed by the incorporation of a trigger release mechanism that prevents the trigger from being depressed until a trigger release button has cleared the sidewall of the housing.

A hinged cap covers the dispensing outlet of the container and is connected to the trigger mechanism by a lever, whereby depressing the trigger operates the lever which pivots the cap to its open position, thereby forcing the contents of the container through the dispensing outlet.

An alternate dispensing outlet mechanism includes a ball valve covering the container opening that is retained in place by the sidewall of the housing. The ball valve has a duct formed within a portion of the ball whereby rotation of the ball positions one end of the duct towards the contents of the container, and the other end of the duct towards the outside of the housing. Rotation of the ball valve is accomplished by a reciprocating ratchet mechanism formed by a set of cooperating teeth defined on the ball and the trigger mechanism, whereby upon activating the trigger release, subsequent downward travel of the plunger mechanism opens the ball valve and advances the piston into the container, thereby forcing the contents of the container out of the now opened ball valve. Operation of the combined mechanisms is difficult, if not impossible, for a small child, thereby improving child safety.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
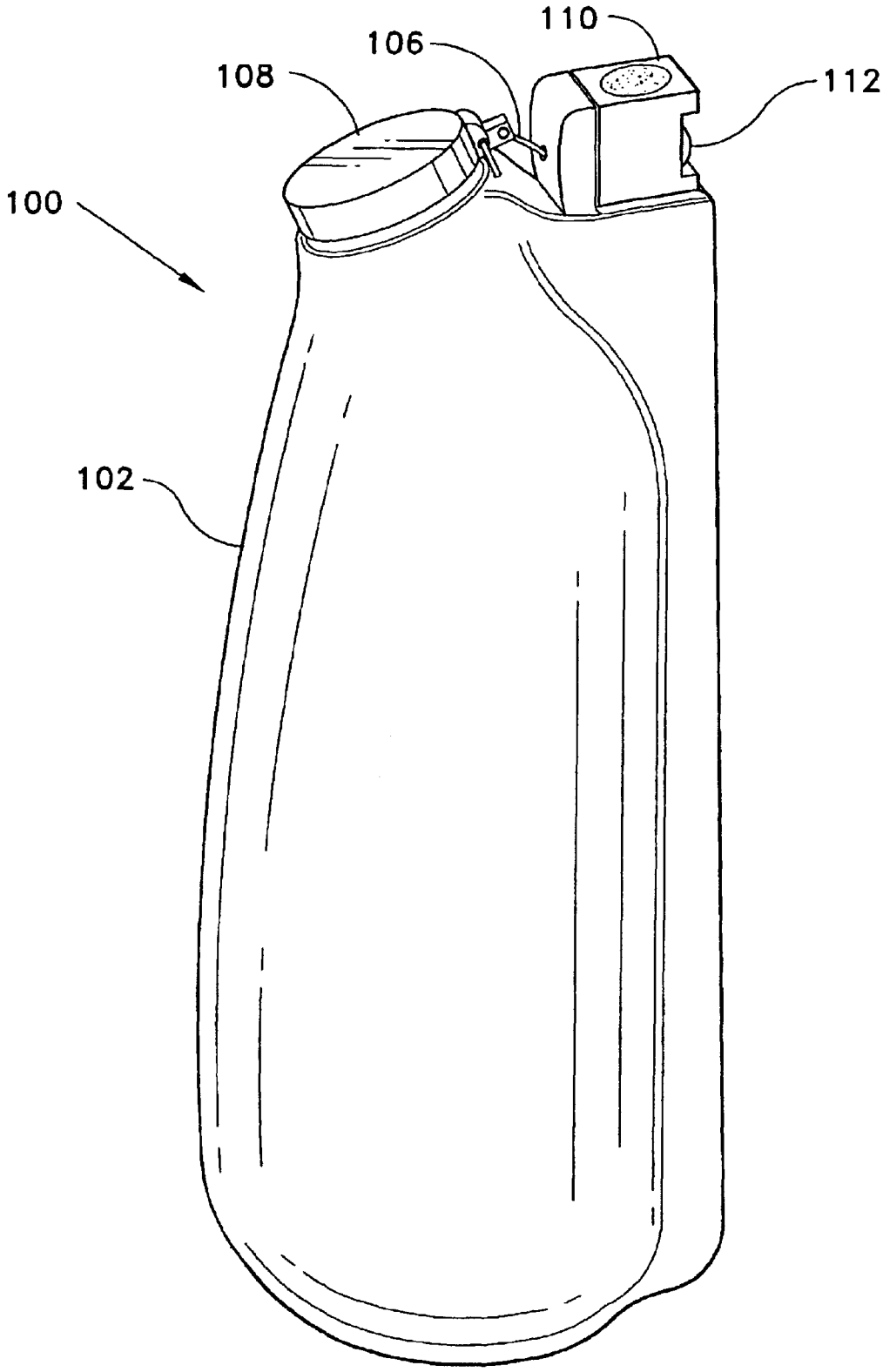
FIG. 1 is a perspective view of a first embodiment of a child safe cream dispenser according to the present invention.
Figure 2:
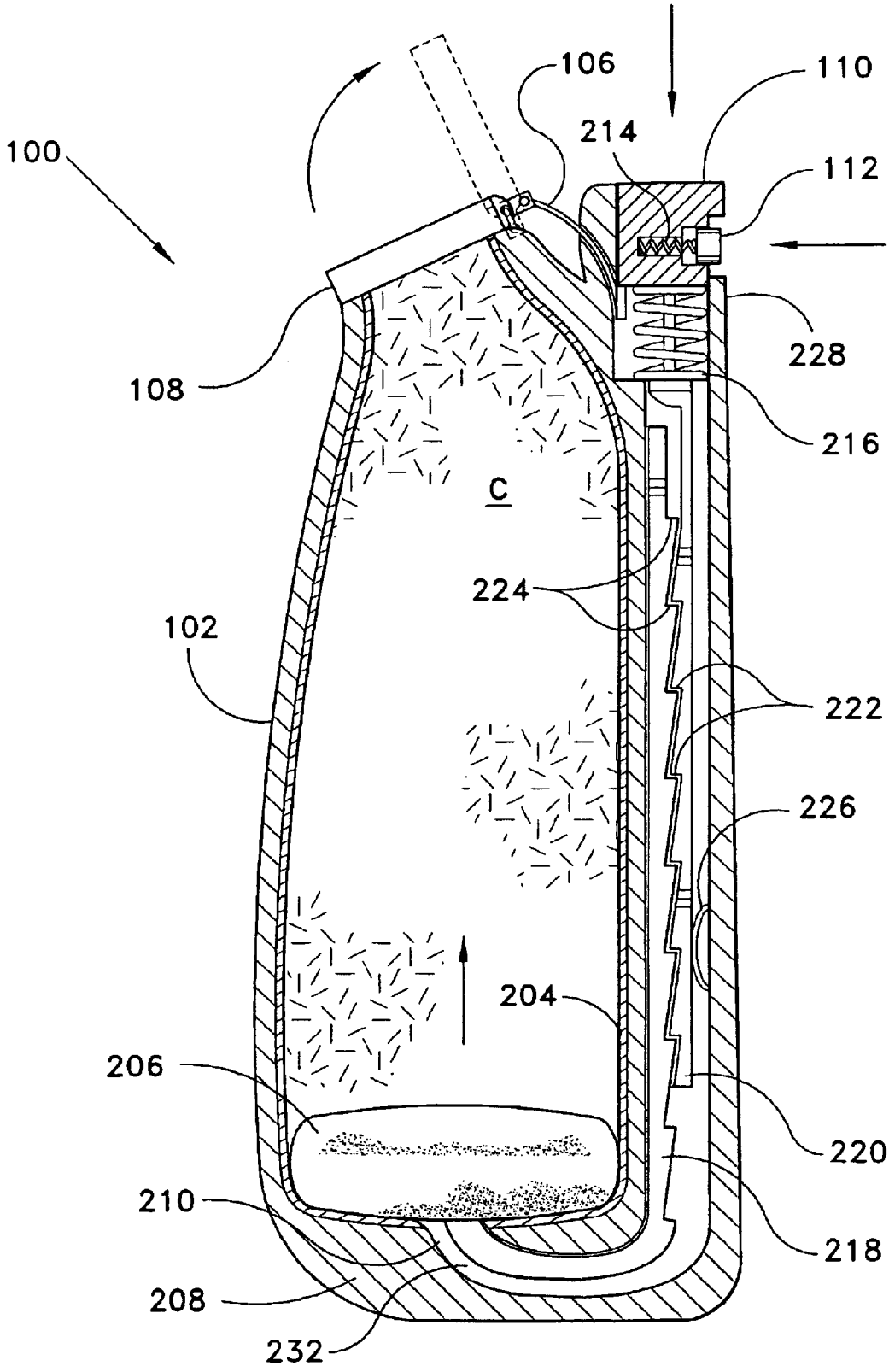
FIG. 2 is a vertical section view of the child safe cream dispenser of FIG. 1 with the plunger trigger in its normal or rest position.
Figure 3:
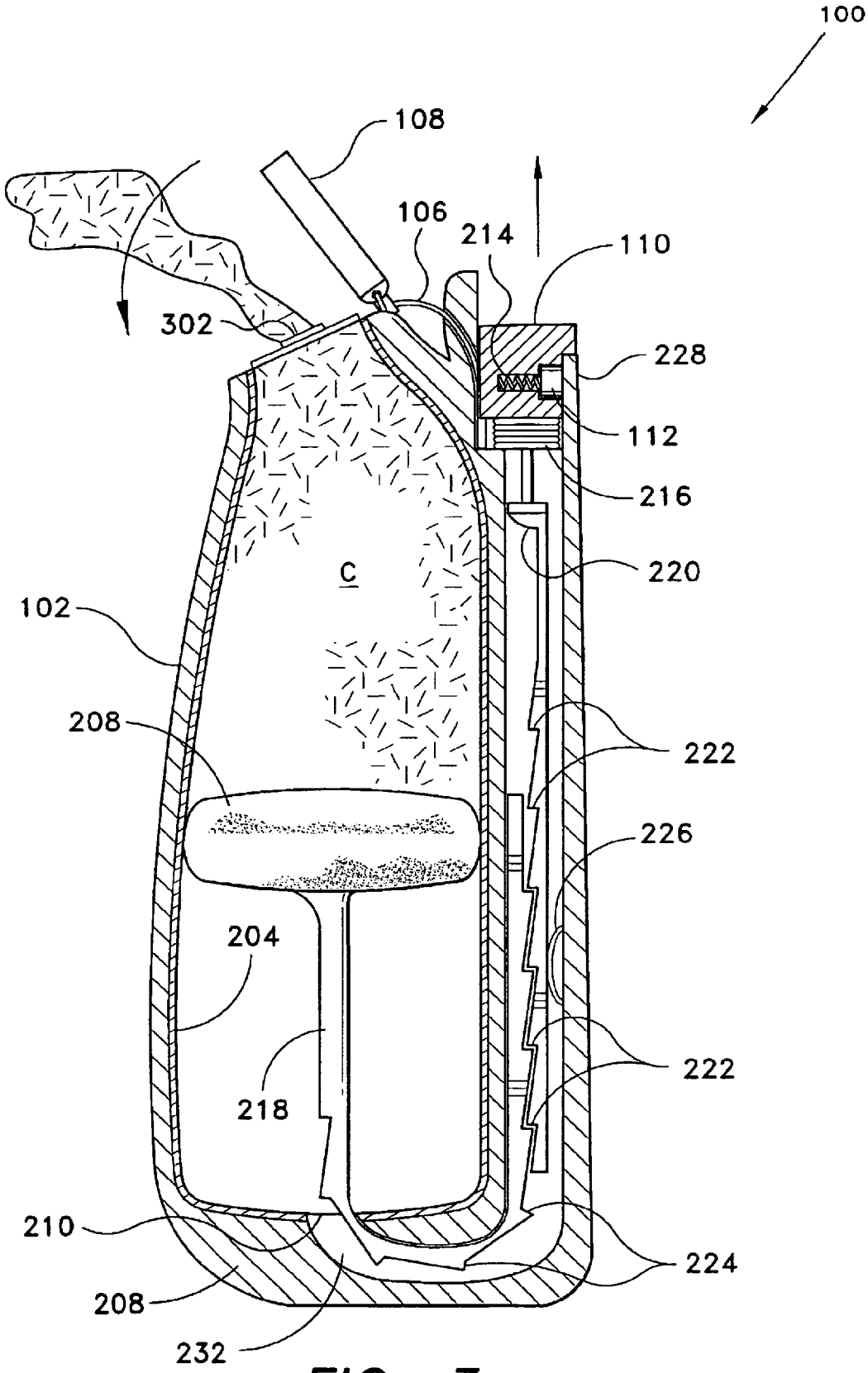
FIG. 3 is a vertical section view of the child safe cream dispenser of FIG. 1 with the plunger trigger in a depressed position and the dispensing outlet cap open.

The present invention is a child safe cream dispenser, designated generally as 100 in the drawings. As shown in FIGS. 1–3, a first embodiment of the invention 100 includes an elongated container 102 having a cap 108 covering a dispensing outlet 302 at the top of the container 102, the cap 108 being pivotally operated by means of a lever 106 connected to a plunger trigger 110. The housing 102 will preferably be made of soft or hard plastic, such as high-density polyethylene or other material adaptable to an injection blow molding process. Depending upon the contents C of the dispenser 100, the dispenser 100 may include a separate lining 204, forming a barrier between the topical cream C and the container 102.

The trigger release button 112, as best shown in the section views of FIGS. 2–3 discourages unauthorized use by small children by requiring simultaneous operation of two actions before the contents C are dispensed from the container.

As best seen in FIG. 2–3, the dispenser 100 also includes a piston 206, preferably of circular design (or of the same cross-sectional shape as the container), slidably received within, but snugly fitting, the interior walls of the container and is designed so that contents C will not pass between the piston 206 and the container walls. The piston 206 is connected to a piston shaft 218 extending through an opening 210 defined in the bottom wall 208 of the container 102 leading into a "J" shaped passageway 232 molded in the bottom wall 208 and sidewall of the container 102. The piston shaft 218, made of flexible and resilient plastic, is designed to conform to and slide within the "J" shaped passageway 232. The dispenser 100 is shown in FIG. 2 completely filled with cream C, the piston 206 being positioned at the bottom of the container 102 and having the majority of the piston shaft 218 extending into the vertical portion of the passageway 232. The piston shaft 218 has a series of upward pitched ratcheted teeth 224 extending along at least a portion of the length thereof, the teeth preferably being disposed on only one side of the piston shaft 218, thereby facilitating the 900 bend at the bottom portion of the passageway 232.

A spring-loaded plunger mechanism comprising a trigger 110, a bias spring 216, and a notched rod 220 depending from the trigger 110 functions by means of a one-way ratchet or clutch mechanism to advance the piston shaft 218 with attached piston 206 such that successive operation of the trigger 110 advances the piston 206 and the cream material C towards the dispensing outlet 302.

A leaf spring 226 disposed at an intermediate position on a lateral surface of the duct or passageway 232 biases the notched rod 220 against the notched portion of the piston shaft 218, the rod 220 having a complementary set of downward pitched notches 222 which cooperatively engages the upward pitched notches 224 of the piston shaft 218.

The spring-loaded trigger 110 is mounted at the top of the housing 102 alongside a hinged outlet cap 108 covering the dispenser opening 302. The cap 108 is connected to the trigger 110 by a lever 106 whereby depressing the trigger 110 operates to pivot the cap 106 to its open position, thereby dispensing the container contents C. The trigger bias spring 216 operates to return the trigger 110 to it normal or rest position in addition to closing the cap 108 once the trigger 110 is released.

The child safety cream dispenser 100 minimizes the unauthorized operation by small children by requiring simultaneous operation of a trigger release mechanism and the plunger mechanism to dispense contents C from the dispenser 100. The trigger release mechanism comprises a horizontal button 112 biased by a spring 214, the purpose of which is to prevent the trigger 110 from being depressed until the trigger release button 112 has cleared the upper sidewall 228 of the housing 102.

For added safety, the child safe cream dispenser 100 is designed for single time use and cannot be opened or refilled. Furthermore, the ratchet mechanism can only operate to advance the piston 206 towards the dispensing outlet, and incorporates no means by which the piston 206 can be repositioned at the bottom 208 of the container 102.

Figure 4:
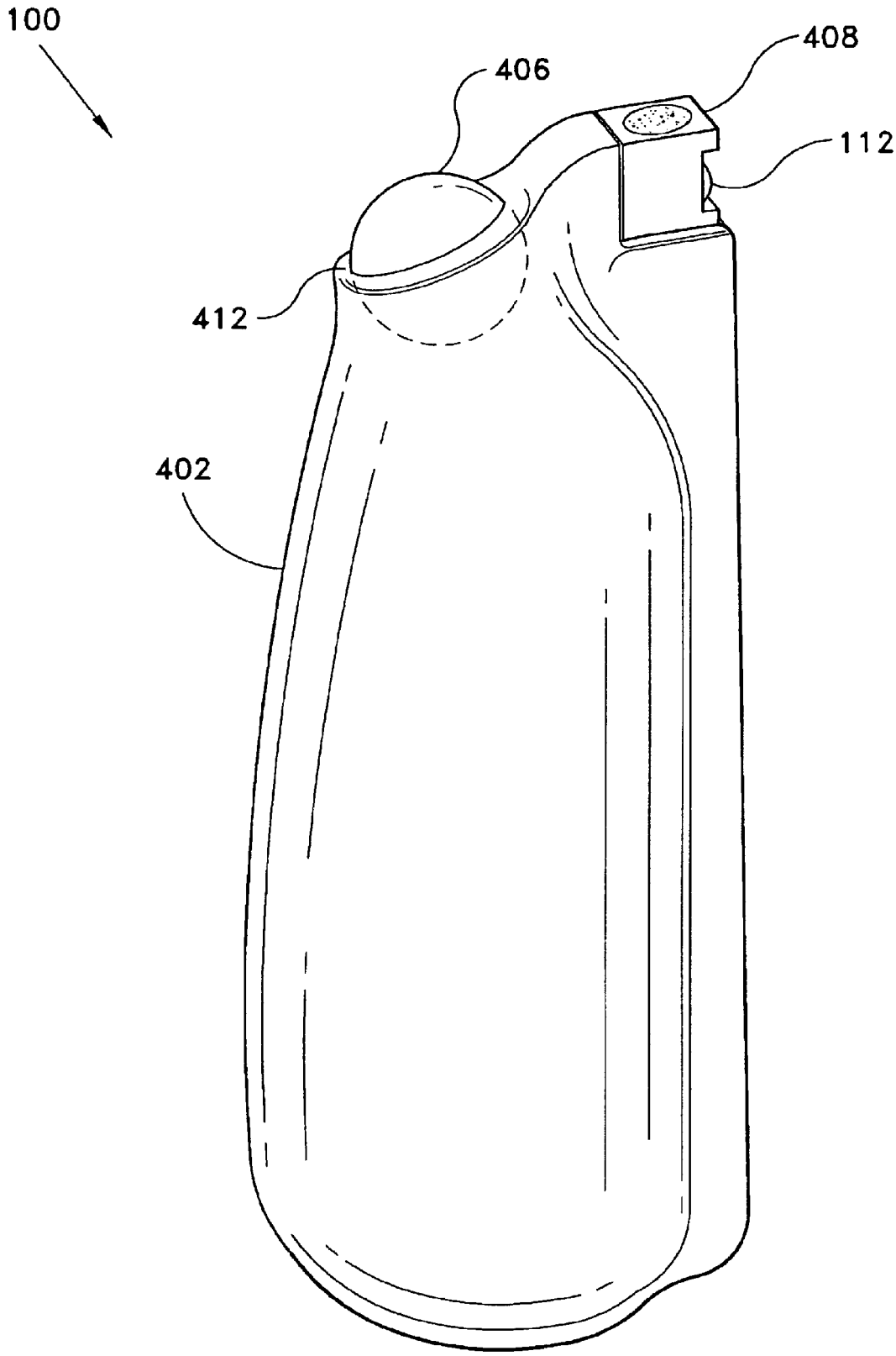
FIG. 4 is a perspective view of a second embodiment of a child safe cream dispenser according to the present invention.
Figure 5:
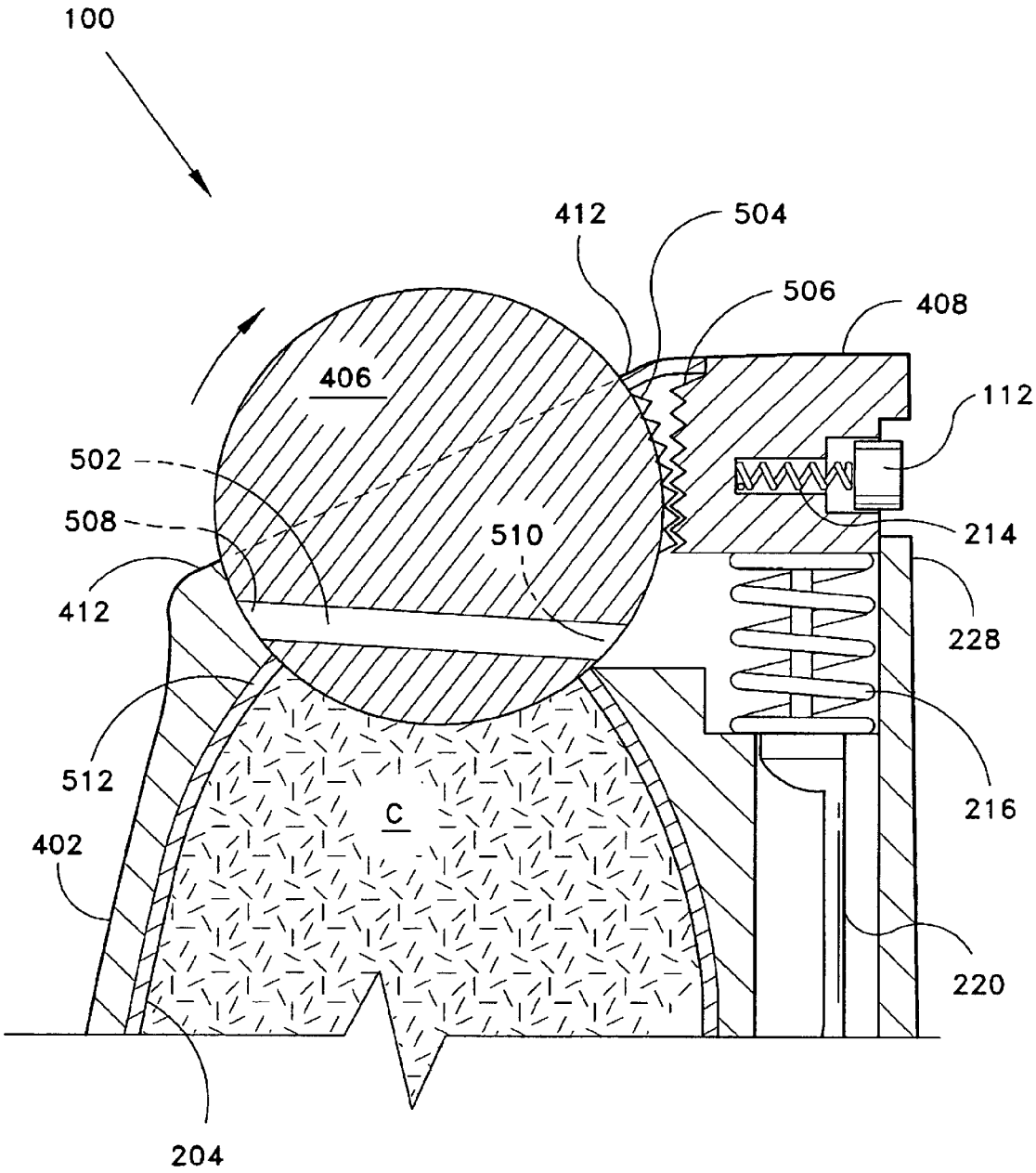
FIG. 5 is a fragmented side view in section of the dispenser of FIG. 4 with the dispenser in the closed position.
Figure 6:
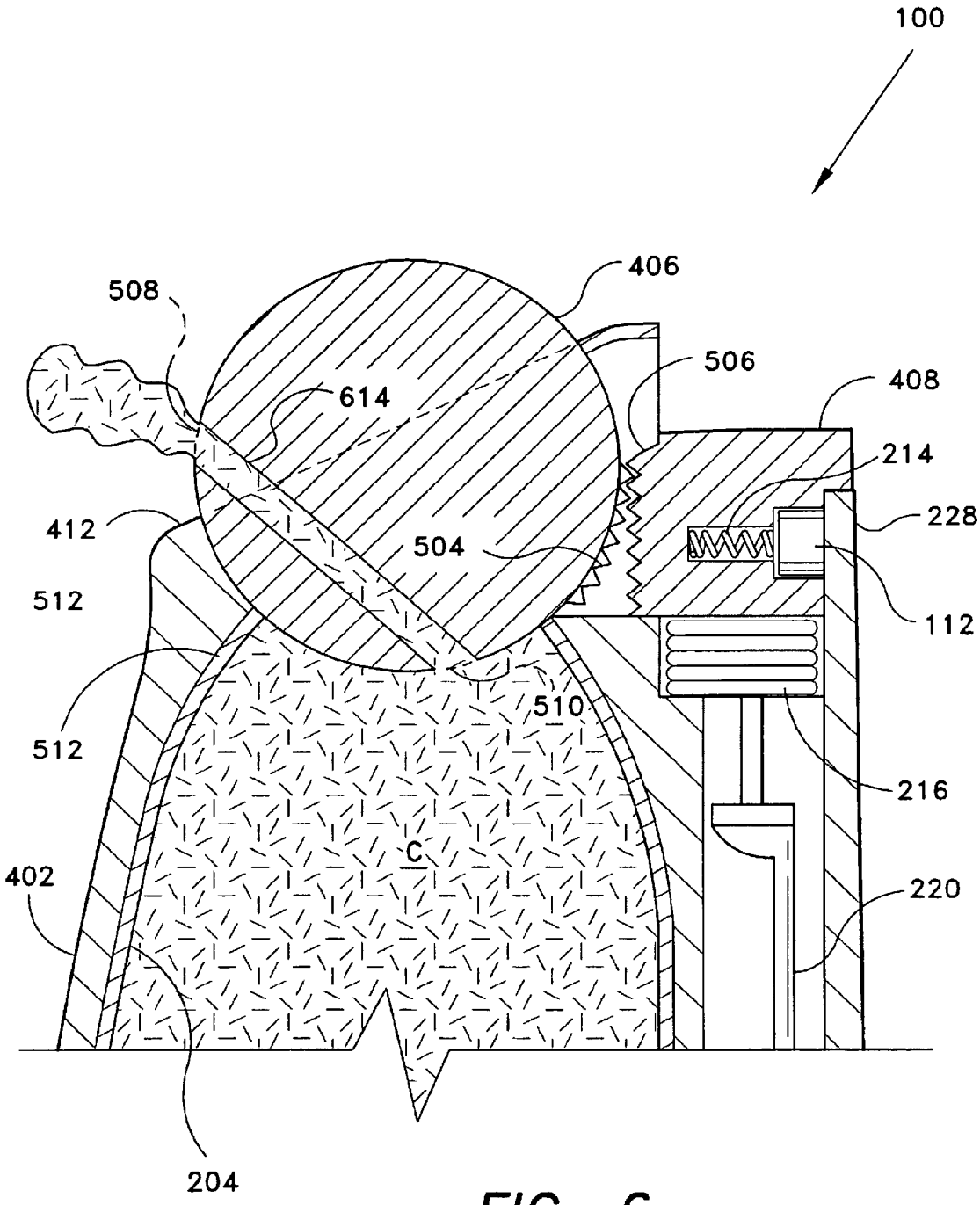
FIG. 6 is a fragmented side view in section of the dispenser of FIG. 4 with the dispenser in the open position.

An alternate dispensing outlet mechanism, shown in FIGS. 4–6, includes a ball valve 406 resting on the opening 512 in the top of the container 402 and retained in place by a circular lip 412, the lip 412 retaining the surface of the ball 406 against the opening formed by the upper sidewall 512 of the container. The ball valve 406 has a duct 502 formed within a portion of the ball 406 whereby rotation of the ball 406 exposes one end 508 of the duct 502 to the outside of the dispenser 100, and the other end 510 of the duct 406 towards the contents C of the container, thereby allowing the contents C of the container 402 to be dispensed through the ball valve 406, as shown in FIG. 6.

Rotation of the ball valve 406 is accomplished by a reciprocating ratchet mechanism formed by a set of cooperating teeth 504, 506 defined on the surface of the ball 406 and on the lateral surface of trigger mechanism 408 respectively. The embodiment shown in FIGS. 4–6 incorporates the same one-way ratchet or clutch mechanism and piston heretofore disclosed and illustrated in FIGS. 1–3, whereby the contents C is urged towards the ball valve 406.

In summary, the operation of the child safe cream dispenser 100 requires simultaneous horizontal depression of the trigger release button 112 and downward travel of the plunger mechanism to rotate the ball valve 406 to an open position, whereupon the contents C of the container 402 is urged out of the now opened ball valve 406 by the piston mechanism. Subsequent release of the trigger 408 results in spring 214 returning the trigger 408 to its normal position, while at the same time, rotating the ball valve 406 to its closed position.

It is to be understood that the present invention is not limited to the embodiments described above, but encompasses any and all embodiments within the scope of the following claims.

We claim:

1. A child safety cream dispenser, comprising:

an elongated housing defining a cavity adapted for storing a topical preparation, the housing having at least one sidewall, an upper end having a dispensing outlet defined therein, and a bottom wall having an aperture defined therein, the housing having a passageway defined therein extending from the aperture defined in the bottom wall through the bottom wall and the sidewall to the upper end of the sidewall;

a piston slidable within and extending transversely across the cavity and against the at least one sidewall in order to prevent the preparation from falling below the piston;

a flexible piston shaft attached to the piston and slidable within the passageway;

a plunger assembly received by an upper portion of the passageway, the assembly having a trigger and a plunger rod depending from the trigger;

a one-way ratchet mechanism extending for at least a portion of the piston shaft and the plunger rod; and a trigger release mechanism disposed in said trigger, whereby the plunger assembly is prevented from advancing the piston without releasing the trigger release mechanism.

2. The child safety cream dispenser according to claim 1, wherein said passageway is a "J" shaped channel molded in the bottom and sidewall of said housing.

3. The child safety cream dispenser according to claim 1, wherein said trigger release mechanism includes a spring-biased button disposed horizontally and extending beyond a portion of said sidewall, whereby downward travel of said plunger rod requires depressing said release button so that the button clears said sidewall.

4. The child safety cream dispenser according to claim 1, wherein said plunger assembly further includes a plunger bias spring encircling an upper portion of said plunger rod below said trigger.

5. The child safety cream dispenser according to claim 1, further comprising a cap pivotally covering said dispensing outlet, the cap being hinged to said plunger assembly, whereby downward travel of said plunger assembly operates to pivot the cap, thereby uncovering said dispensing outlet.

6. The child safety cream dispenser according to claim 1, wherein said plunger rod and said piston shaft each have a series of teeth extending along at least a portion of the length thereof, the teeth of said depending plunger rod cooperatively engaging the toothed portion of said upwardly extending piston shaft.

7. The child safety cream dispenser according to claim 6, wherein said plunger rod teeth comprise downward pitched notches of ratchet teeth, and said piston shaft teeth comprise upward pitched notches of ratchet teeth at a point of engagement of said plunger rod teeth and said piston shaft teeth.

8. The child safety cream dispenser according to claim 1, further comprising a liner disposed on the inside of said housing.

9. The child safety cream dispenser according to claim 1, wherein said dispensing outlet further comprises a ball valve disposed at the top of said housing, the ball valve having a plurality of vertically spaced teeth defined thereon, wherein said ball valve is closed when said trigger is at rest, and said ball valve is open when said trigger is depressed.

10. The child safety cream dispenser according to claim 9, wherein said trigger and said ball valve have a plurality of cooperatively engaging reciprocating ratchet teeth, whereby pressure on said plunger trigger operates to rotate said ball-value open, and return of said trigger rotates said ball valve to the closed position.

11. A child safety cream dispenser, comprising:

an elongated housing, the housing defining a cavity adapted for storing a topical preparation therein, the housing having at least one sidewall, an upper end having a dispensing outlet defined therein, and a bottom wall having an aperture defined therein, the housing having a passageway defined therein extending from the aperture defined in the bottom wall through the bottom wall and the sidewall to the upper end of the sidewall;

a piston slidable within and extending transversely across the cavity and against the at least one sidewall in order to prevent the preparation from falling below the piston;

a flexible piston shaft attached to the piston and slidable within the passageway;

a plunger assembly received by an upper portion of the passageway, the assembly having a trigger, a plunger rod depending from the trigger, and a plunger bias spring encircling an upper portion of the plunger rod below the trigger;

a one-way ratchet mechanism disposed on at least a portion of the piston shaft and the plunger rod; and a trigger release mechanism disposed in said trigger, whereby the plunger assembly is prevented from advancing the piston.

12. The child safety cream dispenser according to claim 11, wherein said one-way ratchet mechanism includes a series of teeth extending along at least a portion of the length of said plunger rod and said piston shaft, whereby the teeth of the depending plunger rod cooperatively engages the toothed portion of the upwardly extending piston shaft when said plunger assembly is depressed, and said notched teeth pass without engaging when said plunger assembly returns to its normal position.

13. The child safety cream dispenser according to claim 12, wherein said plunger rod teeth comprise downward pitched notches of ratchet teeth, and said piston shaft teeth comprise upward pitched notches of ratchet teeth at the point of engagement of said plunger rod teeth to said piston shaft teeth.

* * * * *